US009544678B2

(12) United States Patent
Lorenz et al.

(10) Patent No.: US 9,544,678 B2
(45) Date of Patent: Jan. 10, 2017

(54) PRINTED CIRCUIT BOARD WITH AN ACOUSTIC CHANNEL FOR A MICROPHONE

(75) Inventors: Christian Lorenz, Waterloo (CA); Timothy Kyowski, Kitchener (CA); Mohamad El-Hage, Cambridge (CA); Daryl W. Torgrimson, Waterloo (CA)

(73) Assignee: BlackBerry Limited, Waterloo (CA)

( * ) Notice: Subject to any disclaimer, the term of this patent is extended or adjusted under 35 U.S.C. 154(b) by 1128 days.

(21) Appl. No.: 13/005,164

(22) Filed: Jan. 12, 2011

(65) Prior Publication Data

US 2012/0177229 A1 Jul. 12, 2012

(51) Int. Cl.

| | |
|---|---|
| ***H04R 1/28*** | (2006.01) |
| *H04R 19/00* | (2006.01) |
| *H04R 19/04* | (2006.01) |

(52) U.S. Cl.

CPC ..... *H04R 1/2853* (2013.01); *H04R 19/005* (2013.01); *H04R 19/04* (2013.01); *H04R 2499/11* (2013.01)

(58) Field of Classification Search

CPC ..... H04H 20/26; H04N 5/08; H04R 1/2853; H04R 19/005; H04R 19/04; H04R 2499/11

USPC ... 381/111, 91, 355, 369, 175; 257/416, 676

See application file for complete search history.

(56) References Cited

U.S. PATENT DOCUMENTS

| | | | | |
|---|---|---|---|---|
| 5,929,518 | A | 7/1999 | Schlaiss | |
| 6,108,416 | A | 8/2000 | Collin et al. | |
| 6,882,762 | B2 * | 4/2005 | Brist et al. | 385/14 |
| 7,269,267 | B2 * | 9/2007 | Song et al. | 381/174 |
| 7,505,602 | B2 | 3/2009 | Eaton | |
| 7,508,933 | B2 | 3/2009 | Yang | |
| 7,537,964 | B2 | 5/2009 | Minervini | |
| 7,555,118 | B2 | 6/2009 | Hawker | |
| 8,050,443 | B2 * | 11/2011 | Izuchi et al. | 381/357 |
| 8,339,798 | B2 * | 12/2012 | Minoo et al. | 361/764 |
| 8,351,634 | B2 * | 1/2013 | Khenkin | 381/361 |
| 2005/0254673 | A1 * | 11/2005 | Hsieh et al. | 381/175 |
| 2007/0026905 | A1 * | 2/2007 | Murray | H04M 1/0202 455/570 |
| 2007/0116261 | A1 * | 5/2007 | Hawker | H04M 1/0202 379/419 |
| 2007/0154155 | A1 | 7/2007 | Brist | |
| 2008/0310657 | A1 * | 12/2008 | Tsuchiya et al. | 381/174 |
| 2009/0034760 | A1 * | 2/2009 | Minamio et al. | 381/175 |
| 2009/0232298 | A1 | 9/2009 | Hawker | |

(Continued)

FOREIGN PATENT DOCUMENTS

| | | | |
|---|---|---|---|
| CA | CA 2525357 A1 | 5/2006 | |
| CN | 201533390 * | 7/2010 | H04R 1/08 |

(Continued)

OTHER PUBLICATIONS

International Search Report; PCT/CA2011/050012; Oct. 3, 2011.

*Primary Examiner* — Davetta W Goins
*Assistant Examiner* — Oyesola C Ojo
(74) *Attorney, Agent, or Firm* — Ridout and Maybee LLP

(57) ABSTRACT

A printed circuit board with an acoustic channel for a microphone and a portable electronic device having such a printed circuit board are provided. In accordance with one embodiment, there is provided a microphone assembly, comprising: a printed circuit board (PCB) comprising a board body having at least one signal trace, the printed circuit board defining an acoustic channel within the board body which extends between a microphone aperture in the board body and a plurality of inlet openings in the board body.

17 Claims, 7 Drawing Sheets

(56) References Cited

U.S. PATENT DOCUMENTS

| | | | | |
|---|---|---|---|---|
| 2010/0128914 | A1 | 5/2010 | Khenkin | |
| 2012/0091544 | A1 * | 4/2012 | Reichenbach | H04R 19/005 257/416 |

FOREIGN PATENT DOCUMENTS

| | | | | |
|---|---|---|---|---|
| EP | 1530401 | | 5/2005 | |
| WO | WO 2007018600 | | 2/2007 | |
| WO | WO 2007018600 | A1 | 2/2007 | |
| WO | WO2009066121 | | 5/2009 | |
| WO | WO 2009066121 | A1 * | 5/2009 | H04M 1/0277 |

* cited by examiner

PRINTED CIRCUIT BOARD WITH AN ACOUSTIC CHANNEL FOR A MICROPHONE

TECHNICAL FIELD

The present disclosure relates to microphones for portable electronic devices, and in particular to a printed circuit board with an acoustic channel for a microphone.

BACKGROUND

Electronic devices, including portable electronic devices, have gained widespread use and may provide a variety of functions including, for example, telephonic, electronic messaging and other personal information manager (PIM) application functions. Some portable electronic devices, such as cellular telephones and smartphones, are equipped with microphones to receive audio signals caused by voices or other audio sources.

Microphones are typically located inside portable electronic devices with an acoustic channel extending between the exterior environment and the microphone inside the portable electronic device. Locating the microphone within portable electronic devices and providing a suitable acoustic channel may be difficult due to space restrictions, restricted zones where microphone cannot be located, and other reasons. Accordingly, arrangements which provide an acoustic channel while satisfying other design constraints remain desirable.

DETAILED DESCRIPTION OF EXAMPLE EMBODIMENTS

Figure 1:
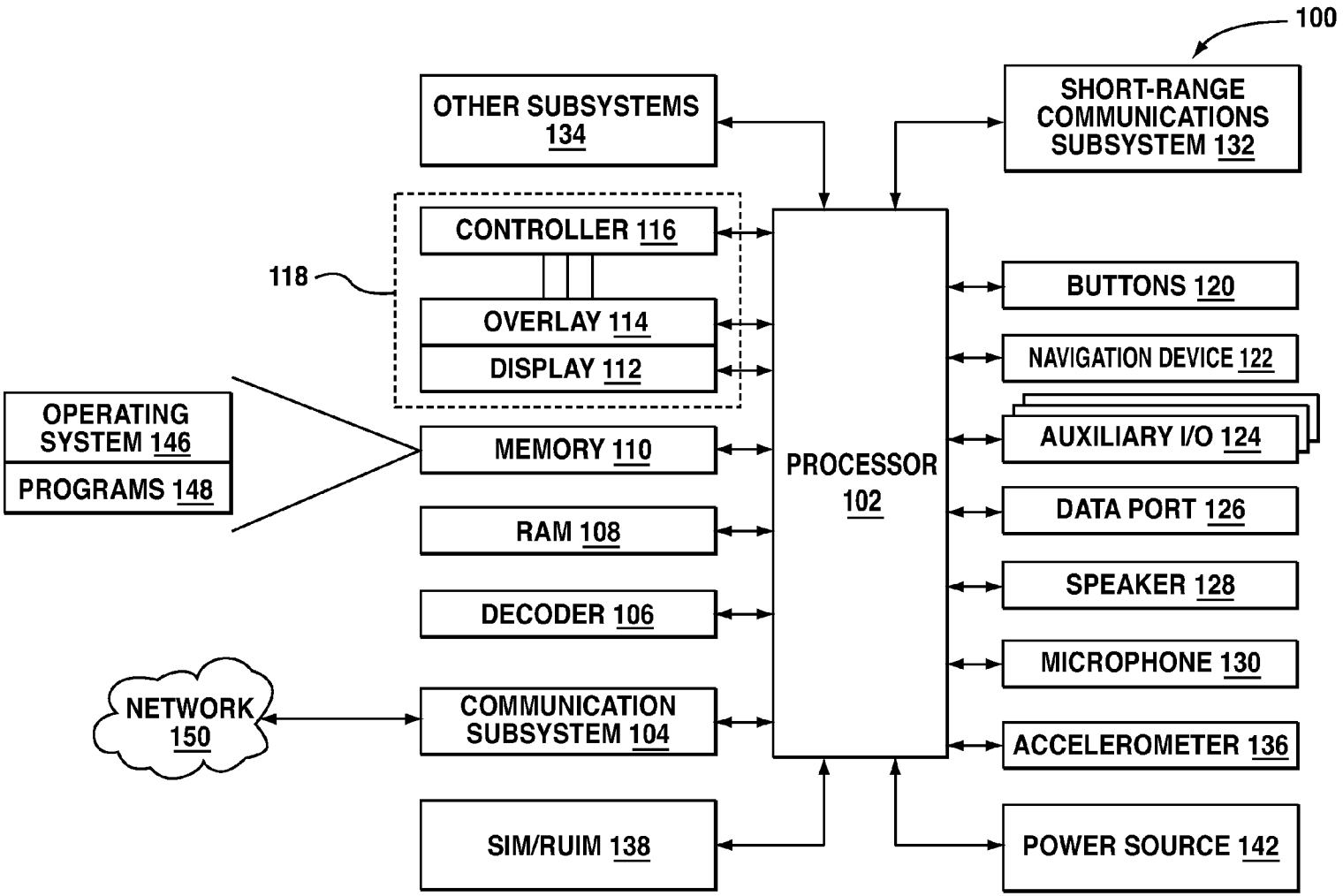
FIG. 1 is a simplified block diagram of components including internal components of a portable electronic device suitable for carrying out the example embodiments of the present disclosure.

In accordance with one embodiment of the present disclosure, there is provided a microphone assembly, comprising: a printed circuit board (PCB) comprising a board body having at least one signal trace, the printed circuit board defining an acoustic channel within the board body which extends between a microphone aperture in the board body and a plurality of inlet openings in the board body.

In accordance with another embodiment of the present disclosure, there is provided a microphone assembly, comprising: a printed circuit board (PCB) comprising a board body having at least one signal trace, the board body having a first surface defining a channel having an open top; and a waveguide extending parallel to the first surface of the board body and which partially covers the open top to provide a covered portion and exposes a first portion of the channel, the exposed first portion of the channel defining an inlet opening, the waveguide and channel collectively defining an acoustic channel in the covered portion, the acoustic channel extending between a microphone aperture in the board body and the inlet opening.

In accordance with a further embodiment of the present disclosure, there is provided a microphone assembly, comprising: a printed circuit board (PCB) comprising a board body having at least one signal trace, the printed circuit board defining an acoustic channel within the board body acoustically connected to at least one inlet opening in the board body; and a microphone received in the acoustic channel and electrically connected to the at least one signal trace in the board body.

In accordance with a further embodiment of the present disclosure, there is provided a portable electronic device, comprising: a housing defining a microphone opening; and a printed circuit board (PCB) received in the housing, the PCB comprising a board body having at least one signal trace, the printed circuit board defining an acoustic channel within the board body which extends between a microphone aperture in the board body and a plurality of inlet openings in the board body; and a microphone comprising a transducer mounted to the board body with the transducer proximate to the microphone aperture in the board body, the microphone being electrically connected to the at least one signal trace in the board body; wherein the plurality of inlet openings in the board body and the microphone aperture in the housing are in approximate alignment.

In accordance with a further embodiment of the present disclosure, there is provided a portable electronic device, comprising: a housing defining a microphone opening; and a printed circuit board (PCB) comprising a board body having at least one signal trace, the board body having a first surface defining a channel; and a waveguide extending parallel to the first surface of the board body which partially covers an open top of the channel to provide a covered portion and exposes a first portion of the channel, the exposed first portion of the channel defining an inlet opening, the waveguide and channel collectively defining an acoustic channel in the covered portion, the acoustic channel extending between a microphone aperture in the board body and the inlet opening; wherein the inlet opening in the board body and the microphone aperture in the housing are in approximate alignment.

In accordance with a further embodiment of the present disclosure, there is provided a portable electronic device, comprising: a housing defining a microphone opening; and a printed circuit board (PCB) comprising a board body having at least one signal trace, the printed circuit board defining an acoustic channel within the board body acoustically connected to at least one inlet opening in the board body; and a microphone received in the acoustic channel and electrically connected to the at least one signal trace in the board body; wherein the at least one inlet opening in the board body and the microphone aperture in the housing are in approximate alignment.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The disclosure generally relates to an electronic device, which is a portable electronic device in the embodiments described herein. Examples of portable electronic devices include mobile, or handheld, wireless communication devices such as pagers, cellular phones, cellular smartphones, wireless organizers, PDAs, wirelessly enabled notebook computers, tablet computing devices, and so forth. The portable electronic device may also be a portable electronic device with or without wireless communication capabilities, such as a handheld electronic game device, digital photograph album, digital camera, or other device.

A block diagram of an example of a portable electronic device 100 is shown in FIG. 1. The portable electronic device 100 includes multiple components, such as a processor 102 that controls the overall operation of the portable electronic device 100. Communication functions, including data and voice communications, are performed through a communication subsystem 104. Data received by the portable electronic device 100 is decompressed and decrypted by a decoder 106. The communication subsystem 104 receives messages from and sends messages to a wireless network 150. The wireless network 150 may be any type of wireless network, including, but not limited to, data wireless networks, voice wireless networks, and networks that support both voice and data communications. A power source 142, such as one or more rechargeable batteries or a port to an external power supply, powers the portable electronic device 100.

The processor 102 interacts with other components, such as Random Access Memory (RAM) 108, memory 110, a display 112 (such as a liquid crystal display (LCD)) with a touch-sensitive overlay 114 operably connected to an electronic controller 116 that together comprise a touch-sensitive display 118, one or more keys or buttons 120, a navigation device 122, one or more auxiliary input/output (I/O) subsystems 124, a data port 126, a speaker (also known as a receiver transducer) 128, a microphone 130, short-range communications subsystem 132, and other device subsystems 134. User-interaction with a graphical user interface (GUI) is performed through the touch-sensitive overlay 114. The processor 102 interacts with the touch-sensitive overlay 114 via the electronic controller 116. Information, such as text, characters, symbols, images, icons, and other items that may be displayed or rendered on a portable electronic device, is displayed on the touch-sensitive display 118 via the processor 102. The processor 102 may interact with an accelerometer 136 that may be utilized to detect direction of gravitational forces or gravity-induced reaction forces.

The buttons 120, represented individually in FIG. 2 by references 120A, 120B, 120C and 120D, are located below the touch-sensitive display 118 on a front face 202 of the portable electronic device 100. The buttons 120 generate corresponding input signals when activated. The buttons 120 may be constructed using any suitable button (or key) construction such as, for example, a dome-switch construction. The actions performed by the portable electric device 100 in response to activation of respective buttons 120 are context-sensitive. The action performed depends on a context that the button was activated. The context may be, but is not limited to, a device state, application, screen context, selected item or function, or any combination thereof.

The buttons 120, in the shown embodiment, are an answer (or send) button 120A, menu button 120B, escape (or back) button 120C, and a hang up (or end) button 120D. The send/answer button 120A may be used for answering an incoming voice call, invoking a menu for a phone application when there is no voice call in progress, or initiating an outbound voice phone call from the phone application when a phone number is selected in the phone application. The menu button 120B may be used to invoke a context-sensitive menu comprising context-sensitive menu options. The escape/back button 120C may be used to cancel a current action, reverses (e.g., "back up" or "go back") through previous user interface screens or menus displayed on the touch-sensitive display 118, or exit the current application 148. The end/hang up button 120D may be used to end a voice call in progress or hide the current application 148.

The navigation device 122 may be a depressible (or clickable) joystick such as a depressible optical joystick, a depressible trackball, a depressible scroll wheel, or a depressible touch-sensitive trackpad or touchpad. FIG. 2 shows the navigation device 122 in the form of a depressible optical joystick. The auxiliary I/O subsystems 124 may include other input devices such as a keyboard or keypad.

To identify a subscriber for network access, the portable electronic device 100 uses a Subscriber Identity Module or a Removable User Identity Module (SIM/RUIM) card 138 for communication with a network, such as the wireless network 150. Alternatively, user identification information may be programmed into memory 110.

The portable electronic device 100 includes an operating system 146 and software applications or programs 148 that are executed by the processor 102 and are typically stored in a persistent, updatable store such as the memory 110. Additional applications or programs 148 may be loaded onto the portable electronic device 100 through the wireless network 150, the auxiliary I/O subsystem 124, the data port 126, the short-range communications subsystem 132, or any other suitable subsystem 134.

A received signal such as a text message, an e-mail message, or web page download is processed by the communication subsystem 104 and input to the processor 102. The processor 102 processes the received signal for output to the display 112 and/or to the auxiliary I/O subsystem 124. A subscriber may generate data items, for example e-mail messages, which may be transmitted over the wireless network 150 through the communication subsystem 104. For voice communications, the overall operation of the portable electronic device 100 is similar. The speaker 128 outputs audible information converted from electrical signals, and the microphone 130 converts audible information into electrical signals for processing.

Figure 2:
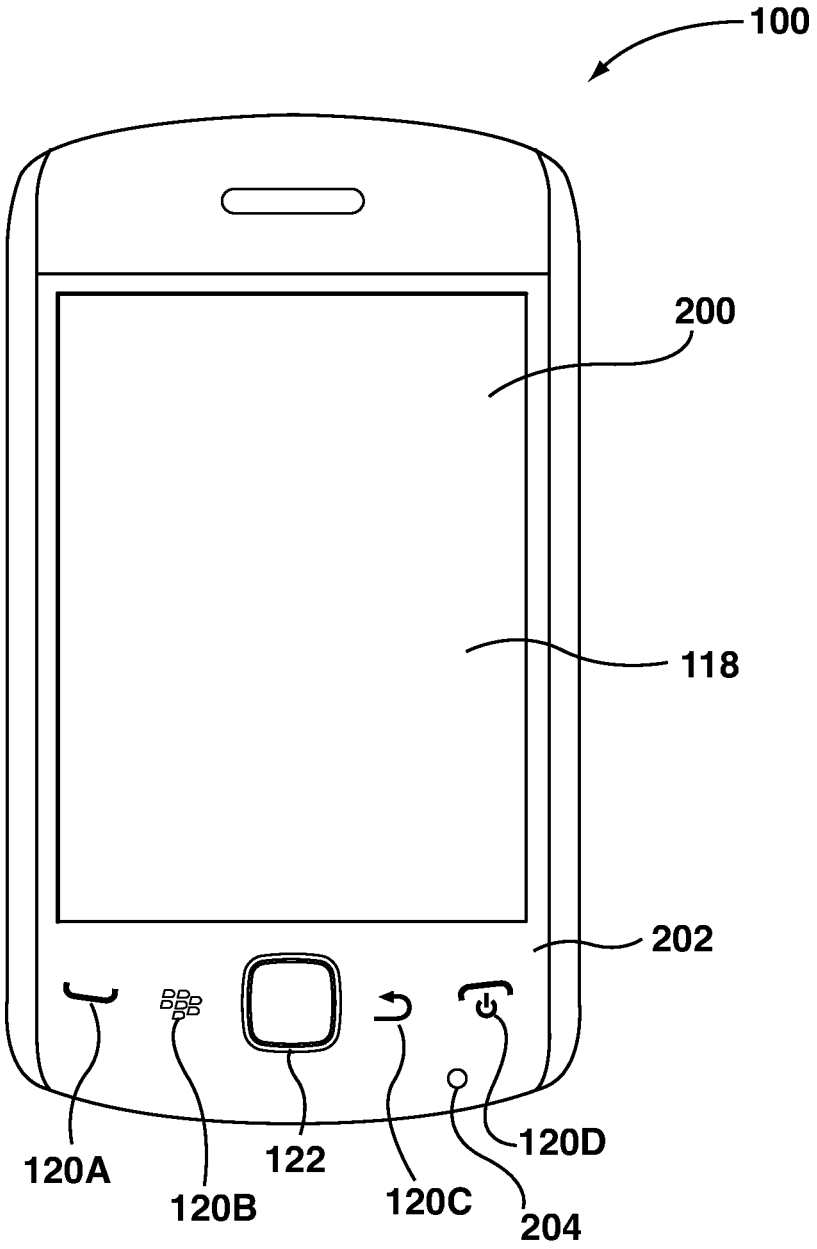
FIG. 2 is a front view of an example of a portable electronic device in a portrait orientation.

FIG. 2 shows a front view of an example of the portable electronic device 100 in portrait orientation. The portable electronic device 100 includes a housing 200 that houses internal components including those internal components shown in FIG. 1 and frames the touch-sensitive display 118 such that the touch-sensitive display is exposed for user-interaction therewith when the portable electronic device 100 is in use. The housing 200 includes a front face 202 having a microphone inlet 204 defined therein. The housing 200 also includes a back face, left side, right side, top and bottom cap. The directional references used in the present disclosure, such as front, back, left side, right side, top and bottom provide relative positional references for device components for convenience only and are not meant to be limiting, unless otherwise noted.

The touch-sensitive display 118 may include any suitable number of user-selectable features rendered thereon, for example, in the form of virtual buttons for user-selection of, for example, applications, options, or keys of a keyboard for user entry of data during operation of the portable electronic device 100.

The touch-sensitive display 118 may be any suitable touch-sensitive display, such as a capacitive, resistive, infrared, surface acoustic wave (SAW) touch-sensitive display, strain gauge, optical imaging, dispersive signal technology, acoustic pulse recognition, and so forth, as known in the art. A capacitive touch-sensitive display includes a capacitive touch-sensitive overlay 114. The overlay 114 may be an assembly of multiple layers in a stack including, for example, a substrate, a ground shield layer, a barrier layer, one or more capacitive touch sensor layers separated by a substrate or other barrier, and a cover. The capacitive touch sensor layers may be any suitable material, such as patterned indium tin oxide (ITO).

One or more touches, also known as touch contacts or touch events, may be detected by the touch-sensitive display 118. The processor 102 may determine attributes of the touch, including a location of a touch. Touch location data may include an area of contact or a single point of contact, such as a point at or near a centre of the area of contact. The location of a detected touch may include x and y components, e.g., horizontal and vertical components, respectively, with respect to one's view of the touch-sensitive display 118. For example, the x location component may be determined by a signal generated from one touch sensor, and the y location component may be determined by a signal generated from another touch sensor. A signal is provided to the controller 116 in response to detection of a touch. A touch may be detected from any suitable object, such as a finger, thumb, appendage, or other items, for example, a stylus, pen, or other pointer, depending on the nature of the touch-sensitive display 118. Multiple simultaneous touches may be detected.

In other embodiments, the touch-sensitive display 118 may be replaced with a conventional non-touch-sensitive display screen, such as a LCD screen, and a keyboard or keypad may be provided as an input device for the portable electric device 100.

Referring now to FIGS. 5 to 8, one example embodiment of a microphone assembly 500 for the portable electronic device 100 in accordance with the present disclosure will be described. The microphone assembly 500 comprises a rigid printed circuit board (PCB) 504 comprising a board body 506 having one or more signal traces (not shown) for receiving electric audio signals generated by the microphone 130 and transmitting the electric audio signals to the processor 102. The PCB 504 also comprises one or more power traces and one or more ground traces. Alternatively, the PCB 504 may be a flexible PCB supported by a stiffener (not shown). The board body 506 has a top surface 512 and a bottom surface 514 located opposite to the top surface 512.

The PCB 504 typically comprises a number of signal traces, power traces and ground traces separated by a non-conductive (i.e., dielectric) material such as a dielectric polymer. The PCB 504 typically comprises a number of traces each formed by a thin conductive foil patterned onto a dielectric substrate (e.g., sheet). Each trace is patterned onto the dielectric substrate in a desired circuit pattern using, for example, conventional photolithography (or masking) and etching techniques. The conductive foil is typically copper, although other conductive materials may be used. The PCB 504 forms a PCB stackup configuration which typically comprises alternating core layers and prepreg layers which are laminated together. Core layers are thin layers of dielectric substrate having a trace patterned on one or more sides. The dielectric substrate in the core layers is typically a cured fiberglass-epoxy resin. The prepreg layers are thin layers of the dielectric substrate which do not have any traces. The dielectric substrate in the prepreg layers is typically an uncured fiberglass-epoxy resin.

The PCB 504 defines an acoustic channel 520 within the board body 506 which extends between a microphone aperture 508 in the board body 506 and a plurality of inlet openings 510 in the board body 506. The inlet openings 510 are typically arranged in a predetermined formation with the inlet openings 510 equally spaced apart from each other for more uniform acoustic performance. The inlet openings 510 are relatively small in size, e.g., 40 to 80 μm in diameter in some embodiments.

In one embodiment, the acoustic channel 520 is formed in the PCB 504 during the lamination process of its manufacture. To form the acoustic channel 520, some of the core and prepreg layers of the PCB stackup are formed with holes in the dielectric substrate. The core and prepreg layers are aligned during the lamination process so that holes in adjacent layers are aligned, the holes in adjacent layers collectively forming the acoustic channel 520. In some embodiments, the acoustic channel 520 may have a depth (or height) of approximately 440 μm. After the core and prepreg layers have been laminated together, the microphone aperture 508 is mechanical drilled using depth controlled drilling techniques. The plurality of inlet openings 510 are then formed using laser drilling. Any excised PCB material in the acoustic channel 520 following drilling operations is removed. The plurality of inlet openings 510 are laser drilled with a diameter of 40 μm, 80 μm or other suitable diameter.

In other embodiments, the microphone aperture 508 and plurality of inlet openings 510 may be formed using laser drilling, or may be formed using a series of holes in adjacent layers similar to the manner in which the acoustic channel 520 is formed.

The microphone aperture 508 and the plurality of inlet openings 510 may be defined on a common surface of the board body 506, or on different surfaces of the board body 506. In the shown example, the plurality of inlet openings 510 are defined in the top surface 512 of the board body 506 along with the microphone aperture 508 and microphone 130 (FIG. 1). In other embodiments, the plurality of inlet openings 510 may be defined in the bottom surface 514 of the board body 506 while the microphone aperture 508 and microphone 130 are located on the top surface 512 opposite to the plurality of inlet openings 510.

The microphone assembly 500 also comprises a microphone 130 which is mounted to the board body 506. The microphone 130 is electrically connected to the signal trace in the board body 506. Electrical contacts (not shown) of the microphone 130 are electrically connected to corresponding electrical contacts on the PCB 504. The microphone 130 comprises a casing 530 which defines an opening 532. The operational components of the microphone 130, including an acoustic-to-electric transducer 534 for converting acoustic audio signals into electrical audio signals, are located inside in the casing 530. The transducer 534 is located inside the casing 530 proximate to the opening 532 in the casing and the microphone aperture 508 in the board body 506.

The microphone 130 is radio frequency (RF) shielded to isolate the microphone 130 from electromagnetic interference. Electromagnetic interference may originate from signals received and generated by antennas (not shown) which are part of the communication subsystem 104. In other embodiments, a non-RF shielded microphone could be used in which case an RF shield (not shown) may be provided to cover the microphone 130 on the PCB 504 to provide an electromagnetic shield to assist in isolating the microphone 130 from electromagnetic interference. RF shield cans are known in the art and so will not be described herein.

Figure 7:
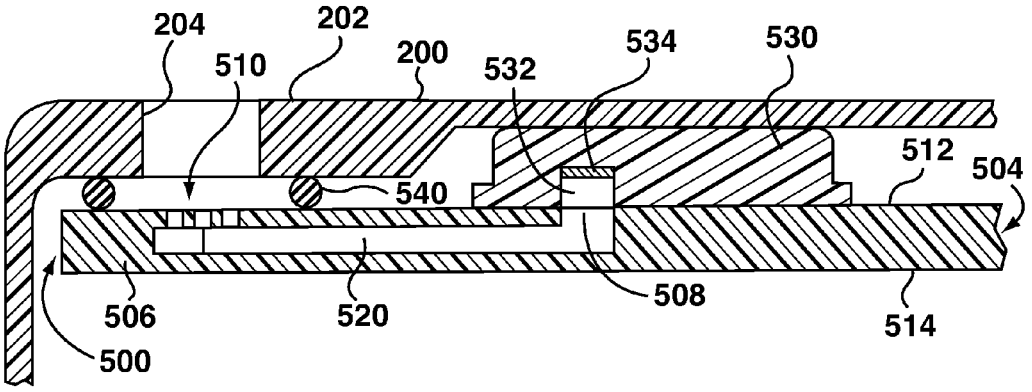
FIG. 7 is a cross-sectional view of the microphone assembly of FIG. 6 in a host portable electronic device.

As best shown in FIG. 7, the plurality of inlet openings 510 is located below the microphone inlet 204 in the front face 202 of the housing 200. The plurality of inlet openings 510 in the board body 506 is in approximate alignment with the microphone inlet 204 in the housing 200, thereby allowing acoustic audio signals from an environment outside of the portable electronic device 100 to pass into and through the acoustic channel 520 and reach the microphone 130. In the shown example, an air gap within the housing 200 separates the front face 202 from the PCB 504. The air gap is sealed to create a sealed acoustic path between the microphone 130 and the environment outside of the portable electronic device 100 as described below. In other embodiments, the inner surface of the front face 202 may meet the top surface 512 of the PCB 504 such that there is substantially no air gap separating the front face 202 from the PCB 504.

The operation of the acoustic channel 520 will now be briefly described. Acoustic audio signals from the environment outside of the portable electronic device 100 pass through the microphone inlet 204 in the front face 202 and into the plurality of inlet openings 510. The acoustic audio signals then pass from the plurality of inlet openings 510 through the acoustic channel 520 to the microphone aperture 508 in the board body 506. The acoustic audio signals then pass from the microphone aperture 508 in the board body 506 through the opening 532 in the casing 530 of the microphone 130. The acoustic audio signals are then picked up by the acoustic-to-electric transducer 534 which converts the acoustic audio signals into electrical audio signals which are transmitted to the processor 102 via the PCB 504.

The acoustic channel 520 in its shape and geometry provides an acoustic waveguide or a resonator due to acoustic wave propagation inside the acoustic channel 520. The acoustic wave propagation causes standing waves at a first resonance at higher frequencies of the acoustic frequency band, typically greater than 4 kHz to 5 kHz for narrowband telephony. The length of the acoustic channel 520 determines the frequency of the first resonance. The frequency of the acoustic channel 520 is typically selected so that the first resonance is close to, or within, the band limits of transmitted speech/audio (typically in the range of 4 kHz to 10 kHz) resulting in unwanted resonance effects. To control the resonance effects of the acoustic channel 520 to avoid negative effects on speech quality, acoustic resistive elements are typically used at the end of the acoustic channel 520 close to the microphone inlet 204 in the housing 200 or directly at the microphone inlet 204.

In the shown example, the plurality of small inlet openings 510 in the board body 506 having a high acoustic resistance are used as acoustic resistive elements. The plurality of inlet openings 510 avoid the need fora mesh screen which provides resonance dampening for the acoustic waveguide shaped by the acoustic channel 520 in front of the microphone 130 and protects against foreign objects entering the interior of the housing 200 and the acoustic channel 520. The plurality of inlet openings 510 in the board body 506 are grouped within a microphone inlet area 516 of the board body 506. The microphone inlet area 516 is approximately the same size and shape as the microphone inlet 204 in the housing 200. The inlet openings 510 in the shown example are generally circular. Circular-shaped inlet openings 510 may be easier to manufacture than other shapes and may have better acoustic performance. Inlet openings 510 of different shapes may be used in other embodiments.

Numerous permutations of the size and number of inlet openings 510 are possible. The plurality of inlet openings 510 define an open area in the top surface 512 of the PCB 504 of between approximately 0.2 $mm^2$ and approximately 0.4 $mm^2$, which is thought to provide suitable acoustic performance. In some example embodiments, the plurality of inlet openings 510 are each approximately 80 μm in diameter and number between 10 and 20, which may be used to provide the open area of between approximately 0.2 $mm^2$ and approximately 0.4 $mm^2$. In other example embodiments, the plurality of inlet openings 510 are each approximately 40 μm in diameter and number between 40 and 80 and are used to provide the open area of between approximately 0.2 $mm^2$ and approximately 0.4 $mm^2$. Openings of approximately 40 μm in diameter approximate the size of the openings of acoustic mesh screens, which have well known acoustic performance. However, openings of approximately 40 μm in diameter are more difficult to achieve using manufacturing techniques though such sizes will become more readily attainable as manufacturing techniques continue to improve. A different size and number of inlet openings 510 may be used in other embodiments.

The size and shape of microphone inlet 204 in the front face 202 of the housing 200 is designed to meet acoustic requirements. In particular, the size should be sufficiently large to allow acoustic audio signals from the environment (e.g., a user's voice during a voice call) to pass into the interior of the housing 200 and reach the plurality of inlet openings 510. However, the size should be sufficiently small to still provide effective protection against foreign objects (e.g., dust) entering the interior of the housing 200 and the acoustic channel 520, to minimize its effect on the appearance of the front face 202 of the housing 200, or both. Similarly, the size and shape of the plurality of inlet openings 510, the microphone aperture 508 in the board body 506, and the opening 532 in the microphone casing 530 are designed to meet acoustic requirements, in particular, the size and shape should allow acoustic audio signals to enter the acoustic channel 520 and pass through to the transducer 534 of the microphone 130.

Figure 8:
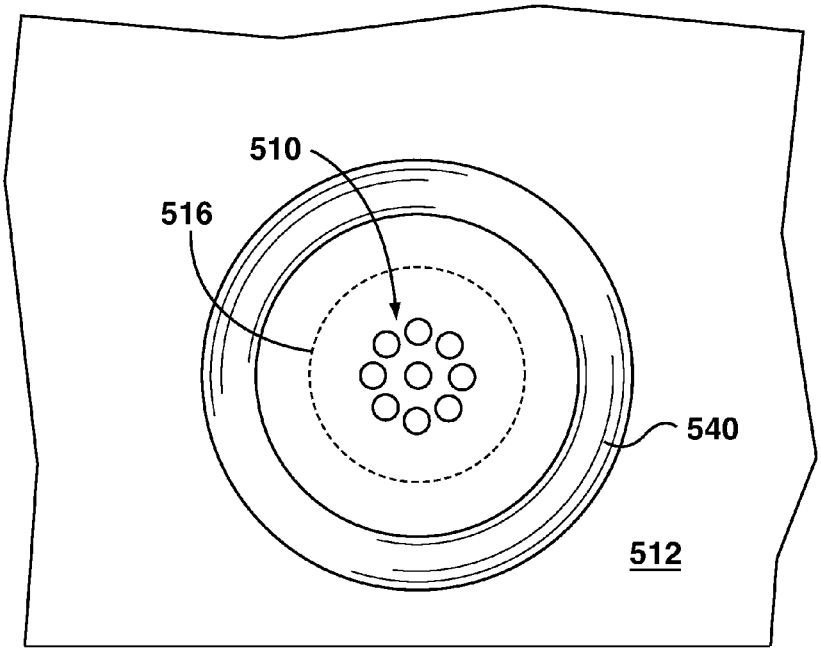
FIG. 8 is a scrap view of the microphone assembly of FIG. 6 showing the sealing member surrounding the inlet openings.

As best shown in FIGS. 7 and 8, a sealing member 540, such as a rubber gasket, may be provided in some embodiments. The sealing member 540 is used to reduce or avoid acoustic couping between the speaker 128 and the microphone 130 within the portable electronic device 100 to avoid echo. The sealing member 540 seals the PCB 504 to the inner surface of the front face 202 of the housing 200. The sealing member 540 may be made of a compressible, non-conductive material such as rubber. The microphone inlet area 516 is configured to fit within an inside dimension of the sealing member 540 which surrounds the microphone inlet area 516 of the board body 506 and seals the board body 506 against the inner surface of the housing 200.

In the shown example embodiment, the plurality of inlet openings 510 in the board body 506 are arranged in a generally circular formation and the sealing member 540 is a circular rubber gasket which surrounds the microphone inlet area 516, which is correspondingly generally circular in shape. In other embodiments, the plurality of inlet openings 510 in the board body 506 may be arranged in a different shape, such as generally square or rectangular formation, resulting in a correspondingly shaped microphone inlet area 516, such as a generally square or rectangular shape. The shape of the sealing member 540 is typically selected to correspond to that of the microphone inlet area 516 to provide a generally uniform clearance resulting in a generally square or rectangular rubber gasket in such embodiments. A generally square or rectangular formation of inlet openings 510 may be easier to manufacture. The clearance may be approximately 0.1 mm in some embodiments.

In some example embodiments, the plurality of inlet openings 510 in the board body 506 are arranged in a generally circular formation and the sealing member 540 is a circular rubber gasket having a thickness of approximately 0.2 to 0.3 mm and an inside diameter of approximately 1 mm. A clearance of approximately 0.2 to 0.3 mm may be provided between an inside dimension of the sealing member 540 and the periphery of the microphone inlet area 516, resulting in a microphone inlet area 516 having a generally circular area approximately 0.4 to 0.6 mm in diameter. The dimensions described immediately above are examples provided for illustration and are not intended to be limiting. Other dimensions are possible. The dimensions described immediately above are dependent, at least in part, on the mechanical tolerances of the parts which may be 0.1 mm in some example embodiments.

In other embodiments, for example when the speaker 128 is not part of the acoustic environment (e.g., as is typical for flip phones and other flip-style portable electronic devices), the area around the microphone inlet area 516 of the PCB 504 may be sealed directly against the inner surface of the front face 202 of the housing 200 without a sealing member 540.

Figure 3:
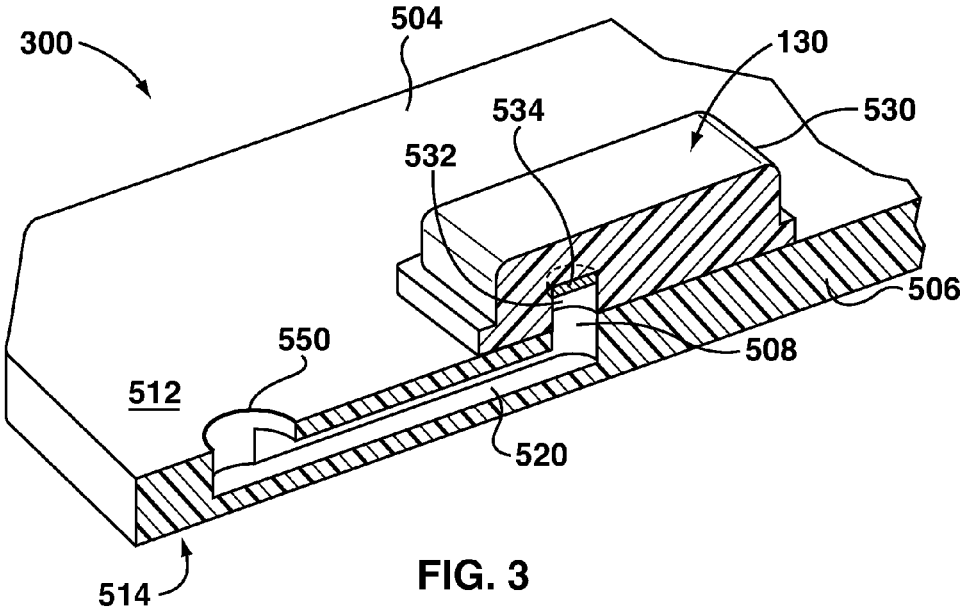
FIG. 3 is a sectional perspective view of a microphone assembly in accordance with one example embodiment of the present disclosure.
Figure 4:
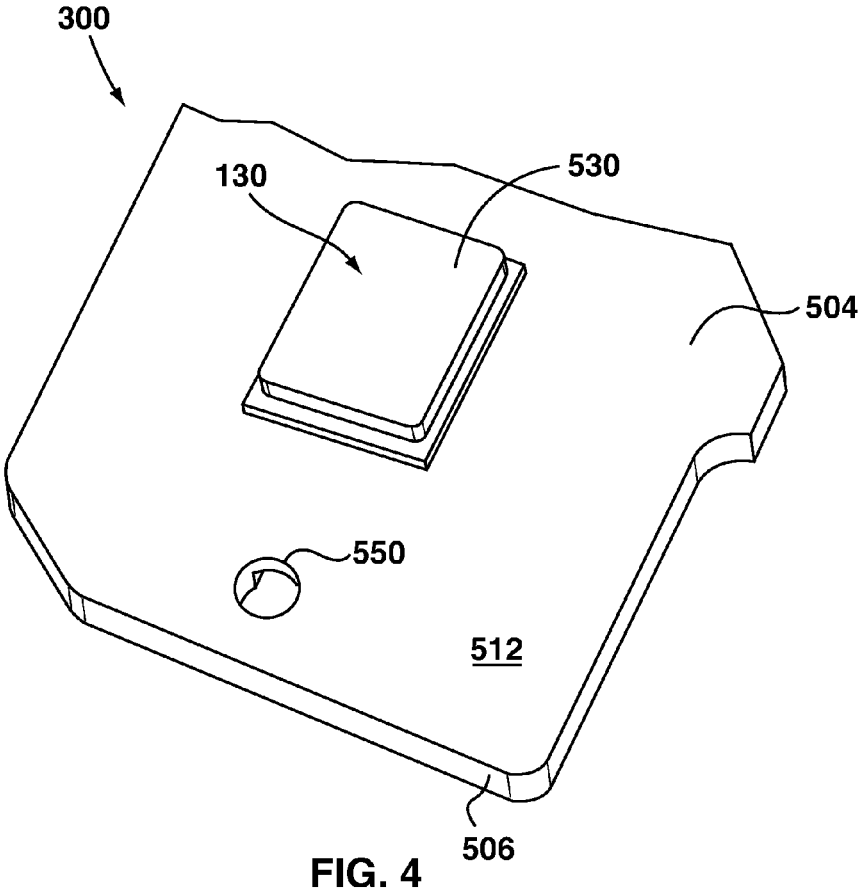
FIG. 4 is an alternate perspective view of the microphone assembly of FIG. 3 taken from above.
Figure 5:
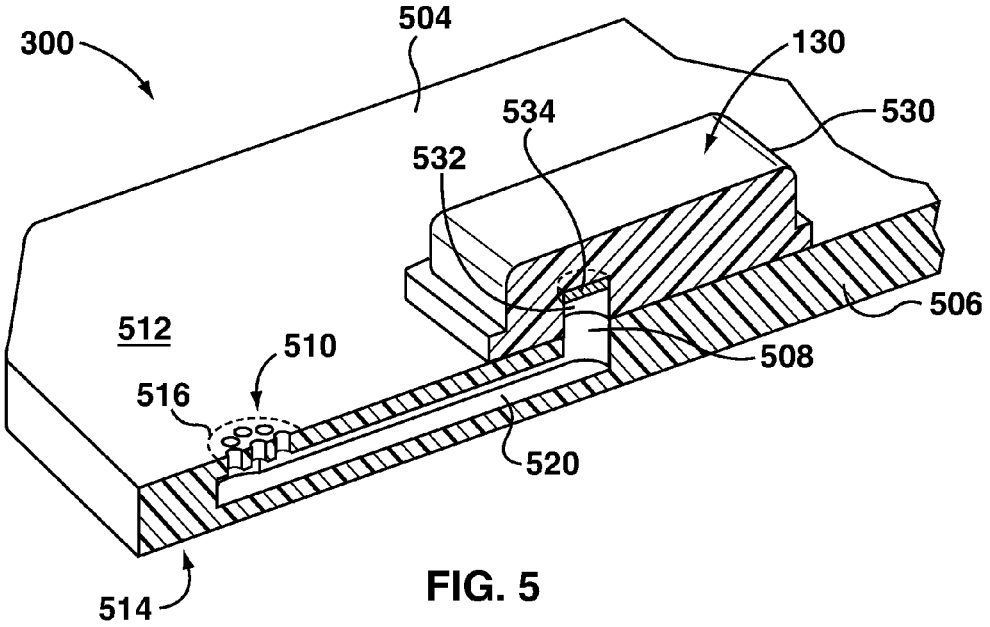
FIG. 5 is a sectional perspective view of a microphone assembly in accordance with another example embodiment of the present disclosure lines.
Figure 6:
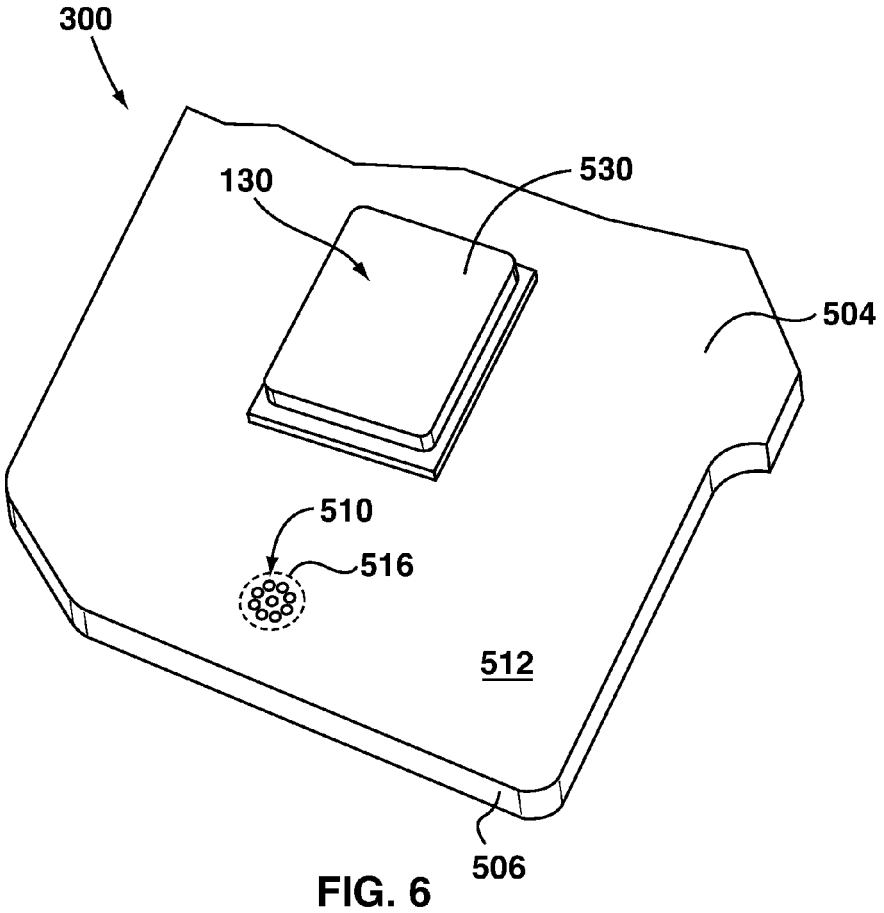
FIG. 6 is an alternate perspective view of the microphone assembly of FIG. 5 taken from above.

Referring now to FIGS. 3 and 4, another example embodiment of a microphone assembly 300 for the portable electronic device 100 in accordance with the present disclosure will be described. The microphone assembly 300 comprises a PCB 504 generally similar to that of the microphone assembly 500 described above. However, instead of a plurality of inlet openings 510 defined in the PCB 504 at the end of the acoustic channel 520 opposite to the microphone aperture 508 in the board body 506, a larger, single aperture 550 is defined. In the shown example, the aperture 550 is located on the top surface 512 of the board body 506 with the microphone aperture 508. However, the aperture 550 may be located on the bottom surface 514 of the board body 506 opposite to the microphone aperture 508 and microphone 130.

A mesh screen (not shown) is provided between a sealing member (not shown) and the front face 202 of the housing 200. The sealing member may be the same or similar to the sealing member 540 described above in connection with the microphone assembly 500. The mesh screen provides acoustic resonance dampening for the acoustic waveguide shaped by the acoustic channel 520 in front of the microphone 130 and protects against foreign objects entering the interior of the housing 200 and the acoustic channel 520. The mesh screen may be made, for example, from stainless steel or fabric cloth. The mesh screen is designed to meet acoustic requirements. The mesh screen may be secured against the inner surface of the front face 202 of the housing 200 using a suitable adhesive. Alternatively, the sealing member 540 may press the mesh screen against the inner surface of the front face 202 of the housing 200 to hold it in place. Alternatively, the mesh screen may be provided within the sealing member 540.

Figure 9:
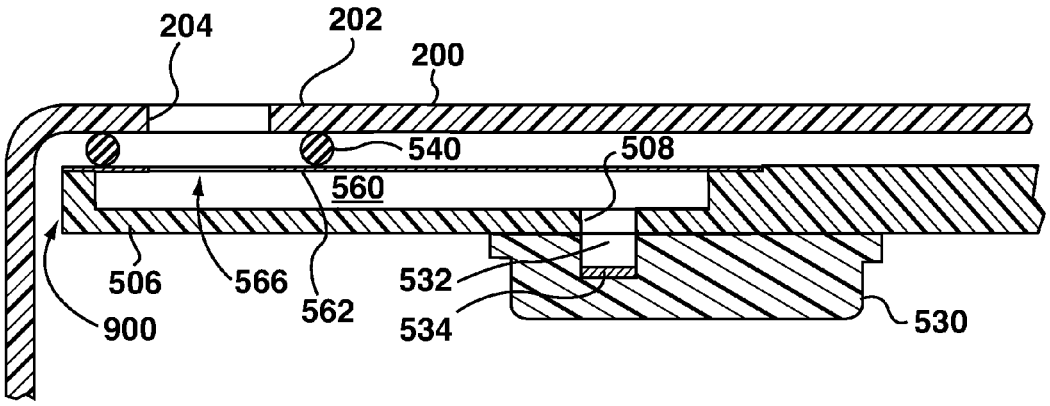
FIG. 9 is a sectional view of a microphone assembly in accordance with a further example embodiment of the present disclosure.

Referring now to FIG. 9, a further example embodiment of a microphone assembly 900 for the portable electronic device 100 in accordance with the present disclosure will be described. The microphone assembly 900 comprises a rigid PCB 504 generally similar to that of the microphone assembly 300 and microphone assembly 500 described above with the notable exception that the acoustic channel 560 has an open top rather than a closed top. The acoustic channel 560 may be formed duration lamination of the PCB 504 as describe above, or may be drilled, milled or otherwise formed in a first surface of the PCB 504. In the shown example, the acoustic channel 560 is formed in the top surface 512 of the PCB 504. The acoustic channel 560 is formed in the dielectric substrate of the PCB 504 in a manner which does not interfere with its various traces.

The microphone assembly 900 also comprises a waveguide 562 which extends substantially parallel to the first surface of the board body 506. The waveguide 562 is formed from an acoustically reflective material, which may be steel, plastic or the PCB material, and may be soldered or glued airtight against the PCB 504. The waveguide 562 is a lid or cover which partially covers an open top of the acoustic channel 560 and exposes a first portion of the acoustic channel 560. The exposed first portion of the acoustic channel 560 defines an inlet opening 566. A microphone aperture 508 is defined by the PCB 504 on a second surface located directly across from the first surface in which the acoustic channel 560 is defined. In the shown example, the microphone aperture 508 is defined in the bottom surface 514 of the PCB 504. The acoustic channel 560 and waveguide 562 collectively define the acoustic channel 560 in the covered portion extending between the microphone aperture 508 and the inlet opening 566. The inlet opening 566 in the board body 506 and the microphone inlet 204 in the housing 200 are in approximate alignment similar to the plurality of inlet openings 510 in the board body 506 of the microphone assembly 500 described above, and the aperture 550 in the board body 506 of the microphone assembly 300 described above.

Figure 10:
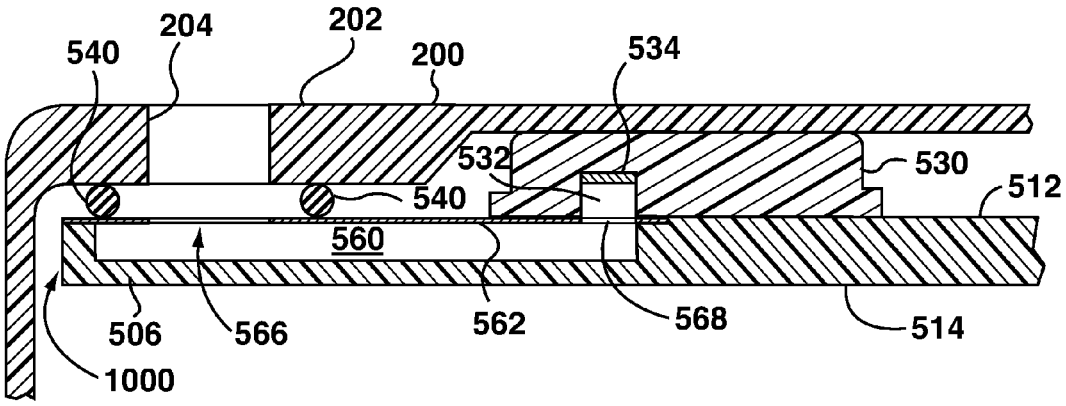
FIG. 10 is a sectional view of a microphone assembly in accordance with a further example embodiment of the present disclosure.

Referring now to FIG. 10, a further example embodiment of a microphone assembly 1000 for the portable electronic device 100 in accordance with the present disclosure will be described. The microphone assembly 1000 comprises a rigid PCB 504 generally similar to that of the microphone assembly 900 described above. However, the waveguide 562 exposes a further portion 568 of the acoustic channel 560 which defines the microphone aperture 508 of the acoustic channel 520. The exposed first portion 566 and the exposed further portion 568 are located towards opposite ends of the acoustic channel 520 on the first surface (e.g., top surface 512 or bottom surface 514) of the PCB 504.

The microphone assembly 900 and microphone assembly 1000 may allow for a PCB with a reduced thickness compared to the other embodiments described herein since additional layers of the PCB 504 above the acoustic channel may be replaced with a lid or cover which partially covers the open top of the acoustic channel to form a waveguide 562. A lid may be used when the additional layers of the PCB 504 are not required to provide circuitry for other device components. The lid may be quite thin to reduce thickness of the PCB as much as possible.

Figure 11:
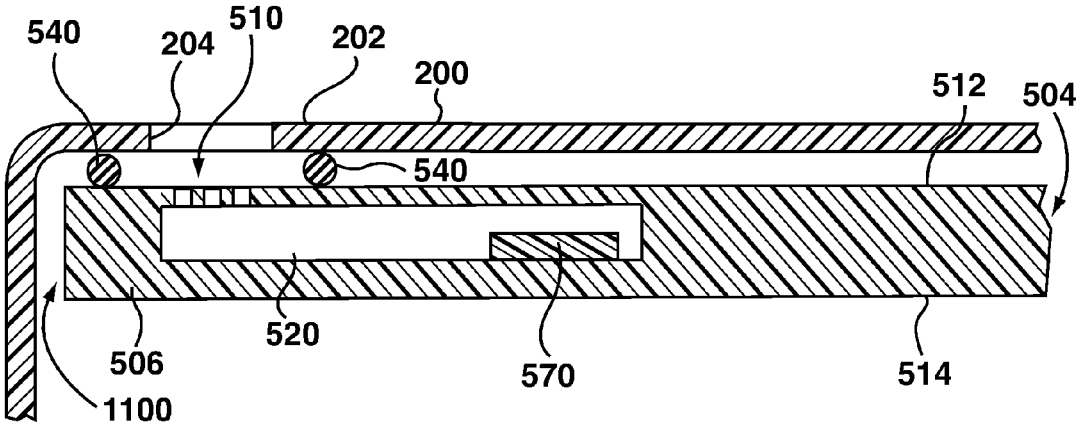
FIG. 11 is a sectional view of a microphone assembly in accordance with a further example embodiment of the present disclosure.

Referring now to FIG. 11, a further example embodiment of a microphone assembly 1100 for the portable electronic device 100 in accordance with the present disclosure will be described. The microphone assembly 1100 comprises a rigid PCB 504 generally similar to that of the microphone assembly 300 and microphone assembly 500 described above. However, the microphone 130 is received in the acoustic channel 520. Although a plurality of inlet openings 510 which are acoustically connected to the acoustic channel 520 are defined in the board body 506 in the shown example, a large single inlet opening in the board body 506 may be used instead of the plurality of inlet openings 510 in other embodiments. The single inlet opening is similar to the aperture 550 of the microphone assembly 300 described above.

The microphone 130 is a MicroElectrical-Mechanical System (MEMS) microphone 570, also referred to as a microphone chip, silicon microphone or reflow microphone. The MEMS microphone 570 comprises a pressure-sensitive diaphragm etched into a silicon chip using MEMS techniques. The pressure-sensitive diaphragm may be provided with an integrated preamplifier and may have a built in analog-to-digital converter (ADC) circuit so as to provide a digital microphone. Alternatively, the MEMS microphone may be connected to an application-specific integrated circuit (ASIC). The MEMS microphone 570 may be electrically connected to the signal trace of the PCB 504 within the acoustic channel 520 via a conductive adhesive, thereby avoiding the need to solder or otherwise surface mount the microphone 130 to the PCB 504 and eliminating any sealing issues resulting from surface mounting the microphone 130. The MEMS microphone 570 may also be electrically connected to a ground trace of the PCB 504 so as to ground the MEMS microphone 570. The microphone assembly 1100 reduces the amount of surface area of the PCB 504 which is required for acoustic integration of the microphone 130, and provides electrostatic discharge (ESD) protection of the microphone 130 when the MEMS microphone 570 is grounded to a ground trace of the PCB 504. The microphone assembly 1100 reduces acoustic leakage when using acoustic porting in the PCB 504 since the MEMS microphone 570 is already embedded into the PCB 504. Embedding the MEMS microphone 570 in the PCB 504 removes one port and one potential source of acoustic leakage.

In other embodiments, when the layers of the PCB 504 are not required to provide circuitry for other device components, the layers of the PCB 504 above the acoustic channel may be replaced with a lid or cover which partially covers an open top of the acoustic channel to form a waveguide as described above in connection with the microphone assembly 900 and microphone assembly 1000. The may be used to reduce the thickness of the PCB 504 as described above.

The microphone assembly described in the present disclosure allows the microphone 130 to be located away from the microphone inlet 204 in the housing 200 of the portable electronic device 100 without requiring a microphone tube (also known as a microphone boot) and its associated drawbacks.

A microphone tube is conventionally used to provide an acoustic channel or path between a microphone 130 and a microphone inlet 204. A microphone tube is a complex mechanical part, typically formed from rubber, which seals against the microphone as well as the microphone opening. Microphone tubes occupy a relatively large amount of space on the PCB and thereby impose restrictions on the location of other device components.

A microphone 130 may be located away from the microphone inlet 204 for several reasons, typically because another device component is mounted to the PCB 504 in the area proximate to the microphone inlet 204, or because the area proximate to the microphone inlet 204 is restricted. For example, antennas (not shown) which are part of the communication subsystem 104 are sometimes mounted to the PCB 504 in the area proximate to the microphone inlet 204. In such cases, the microphone 130 should not be located in the area around the antenna to reduce or eliminate RF electromagnetic interference with the microphone 130. The microphone assembly described herein provides an alternative to a microphone tube which allows the microphone 130 to be located away from the microphone inlet 204, thereby freeing up space on PCB 504 for other device components or a reduction in the footprint/size of the PCB 504, depending on design constraints.

In the above described examples, an acoustic channel formed in the PCB 504 is used for acoustic porting of sound from an environment outside of the portable electronic device 100 to a microphone inside of the portable electronic device 100. An acoustic channel may also be used as air tube or air cavity for porting sound from the speaker 128 through the PCB 504 to the environment outside of the portable electronic device 100.

The present disclosure may be embodied in other specific forms without departing from its spirit or essential characteristics. The described embodiments are to be considered in all respects as being only illustrative and not restrictive. The present disclosure intends to cover and embrace all suitable changes in technology. The scope of the present disclosure is, therefore, described by the appended claims rather than by the foregoing description. All changes that come within the meaning and range of equivalency of the claims are intended to be embraced within their scope.

The invention claimed is:

1. A wireless communication device, comprising:

a housing defining a microphone opening;

a microphone assembly, comprising:

a printed circuit board (PCB) comprising a board body having at least one signal trace, the board body defining an acoustic channel extending between a microphone aperture in the board body and a plurality of inlet openings formed in the board body, each of the plurality of inlet openings having a diameter between substantially 40μm and substantially 80μm;

wherein the plurality of inlet openings in the board body are grouped within a circular microphone inlet area of the board body, wherein the circular microphone inlet area is approximately the same size and shape as the microphone opening in the housing;

a microphone comprising a transducer mounted to the board body, the microphone being electrically connected to the at least one signal trace in the board body, the transducer being located proximate to the microphone aperture in the board body and being acoustically connected to the microphone aperture in the board body;

wherein the microphone opening in the housing and the circular microphone inlet area of the board body in which the plurality of inlet openings are defined are positioned directly opposite to each other and are coaxially aligned with each other.

2. The wireless communication device of claim 1 wherein the microphone aperture and the plurality of inlet openings are defined on a common surface of the board body.

3. The wireless communication device of claim 1 wherein the board body has a top surface and a bottom surface located opposite to the top surface, wherein the microphone aperture and the plurality of inlet openings are defined in the top surface of the board body.

4. The wireless communication device of claim 1 wherein the board body has a top surface and a bottom surface located opposite to the top surface, wherein the microphone aperture and the plurality of inlet openings are defined in the bottom surface of the board body.

5. The wireless communication device of claim 1 wherein the microphone aperture and plurality of inlet openings are defined on different surfaces of the board body.

6. The wireless communication device of claim 1 wherein the microphone comprises a casing which defines an opening therein, the transducer being located inside the casing proximate to the opening in the casing and the microphone aperture in the board body.

7. The wireless communication device of claim 1 wherein the microphone inlet area is configured to fit within an inside dimension of a sealing member which surrounds the microphone inlet area of the board body and seals the board body against an inner surface of the portable electronic device housing.

8. The wireless communication device of claim 7 wherein a clearance is provided between the inside dimension of the sealing member and the microphone inlet area.

9. The wireless communication device of claim 7 wherein the sealing member is a circular rubber gasket.

10. The wireless communication device of claim 1 wherein the plurality of inlet openings define an open area between approximately 0.2 $mm^2$ and approximately 0.4 $mm^2$.

11. The wireless communication device of claim 1 wherein the plurality of inlet openings are each approximately 80 μm in diameter and number between 10 and 20.

12. The wireless communication device of claim 1 wherein the plurality of inlet openings are each approximately 40 μm in diameter and number between 40 and 80.

13. A wireless communication device, comprising:

a housing defining a microphone opening;

a microphone assembly, comprising:

a printed circuit board (PCB) comprising a board body having at least one signal trace, the board body having a first surface and a second surface located opposite to the first surface, the first surface defining an elongated recess that is in communication with a microphone aperture defined in the second surface;

a microphone comprising a transducer mounted to the board body, the microphone being electrically connected to the at least one signal trace in the board body, the transducer being located proximate to the microphone aperture in the board body and being acoustically connected to the microphone aperture in the board body; and a waveguide extending parallel to the first surface of the board body which partially covers the elongated recess, the waveguide and board body collectively defining a linear acoustic channel including a bottom and two opposed ends, wherein the linear acoustic channel acoustically connects an opening defined by the waveguide located towards one end of the linear acoustic channel and the microphone aperture located towards the opposite end of the linear acoustic channel;

wherein the opening defined by the waveguide and the microphone opening in the housing are positioned directly opposite to each other and are coaxially aligned with each other.

14. A microphone assembly, comprising:

a printed circuit board (PCB) comprising:

a board body defining at least one inlet opening and a linear acoustic channel including a bottom and two opposed ends, wherein the linear acoustic channel is acoustically connected to the at least one inlet opening in the board body; and at least one signal trace located on the bottom of the linear acoustic channel; and a microphone located in the body of the PCB within the linear acoustic channel, wherein the microphone is located on the bottom of the linear acoustic channel intermediate the opposed ends of the linear acoustic channel, wherein the microphone is electrically connected to the at least one signal trace located in the bottom of the linear acoustic channel defined in the board body.

15. The microphone assembly of claim 14 wherein the microphone is a MicroElectrical-Mechanical System (MEMS) microphone.

16. The microphone assembly of claim 14 wherein a plurality of inlet openings acoustically connected to the acoustic channel are defined in the board body.

17. A wireless communication device, comprising:

a housing defining a microphone opening;

a microphone assembly, comprising:

a printed circuit board (PCB) comprising a board body having at least one signal trace, the board body having a first surface defining an elongated recess;

a microphone comprising a transducer mounted to the board body, the microphone being electrically connected to the at least one signal trace in the board body;

a waveguide extending parallel to the first surface of the board body which partially covers the elongated recess, the waveguide and board body collectively defining a linear acoustic channel including a bottom and two opposed ends, wherein the linear acoustic channel acoustically connects a first opening defined by the waveguide located towards one end of the linear acoustic channel and a second opening defined by the waveguide located towards the opposite end of the linear acoustic channel, the transducer being located proximate to the second opening in the waveguide and being acoustically connected to the second opening in the waveguide;

wherein the first opening defined by the waveguide and the microphone opening in the housing are positioned directly opposite to each other and are coaxially aligned with each other.

* * * * *